US005520444A

United States Patent [19]

Kosobrodov et al.

[11] Patent Number: 5,520,444

[45] Date of Patent: May 28, 1996

[54] METHOD OF CUTTING AND CUTTING ROTATIVE BIT

[75] Inventors: Yury Kosobrodov, Los Angeles; Vincent Jue, Rolling Hills East, both of Calif.

[73] Assignee: Champion Equipment Co., Paramount, Calif.

[21] Appl. No.: 394,908

[22] Filed: Feb. 27, 1995

[51] Int. Cl.[6] ..... E21C 35/18

[52] U.S. Cl. ..... 299/106; 299/111

[58] Field of Search ..... 299/10, 79, 86, 299/91, 106, 110, 111

[56] References Cited

U.S. PATENT DOCUMENTS 5,078,219 1/1992 Morrell et al. ..... 299/86 X

FOREIGN PATENT DOCUMENTS 3234521 3/1984 Germany ..... 299/86

3336154 4/1985 Germany ..... 299/86

1671850 8/1991 U.S.S.R. ..... 299/86

*Primary Examiner*—David J. Bagnell

*Attorney, Agent, or Firm*—Ilya Zborovsky

[57] ABSTRACT

A rotating cutting tool has a cutting annular element which is mounted and displaced so that the cutting annular element has an attack angle exceeding 90°. The cutting element has a convex cutting front face and a skew angle between 0° and 90°.

12 Claims, 5 Drawing Sheets

METHOD OF CUTTING AND CUTTING ROTATIVE BIT

BACKGROUND OF THE INVENTION

The present invention generally relates to a method & design of cutting and cutting rotative bits, which can be used for excavation, planing and drilling of rock and soil and other non-metallic brittle materials, for destruction or production of construction materials, and be mounted on corresponding equipment, intended for cutting and crushing of the above mentioned materials.

Generally, the cutting process mechanism is as shown in FIG. 1. Cutting of a material, like rock, is carried out by thrust force T and normal component $C_n$ of the cutting force, generated by an equipment drive. Under the action of these forces, the tool simultaneously moves in horizontal and vertical directions generating complicated stresses that overwhelm rock resistance.

Under the action of the force $C_n$, transmitted by the bit front face, compressive stresses are formed in the rock which are not large enough for destruction but preload the rock to resist further strain.

Under the action of the force T, shear stress is produced in the rock due to the high level of load concentration created by the bit's cutting edge. This shear stress provokes generation and development of destructive cracks in the brittle material.

At the same time, both forces $C_n$ and T generate a confined zone of super pressurized rock, located next to the bit cutting edge. This so-called kernel is an accumulator of energy that can discharge in an explosive way when accumulated energy exceeds ultimate rock resistance.

Because the previously mentioned destructive cracks propagate from the cutting edge in the direction of lowest resistance, they initially tend toward the open surface of the rock. However, these cracks can not bypass the enhanced resistance of the volume of the rock compressed by $C_n$. Consequently, the destructive cracks pass around the compressed rock and reach the open surface at a distance L from bit front face, isolating the stressed volume of rock and separating the chip from entire rock massif.

Under continuous combined action of compressive and shear stresses,successive rock chips are separated from the rock mass in a whole or nearly whole condition chiefly due to wide and active destructive cracks or by kernel explosion after sufficient energy is accumulated to overcome crack shortfall.

Therefore, in an effective rock cutting process, it is obligatory to maintain a significant load concentration at the bit cutting edge, which is provided by the positive rear angle $\delta$ of the bit.

Consequently, the effective cutting bit must have an optimal combination of high cutting ability and high durability of the cutting element, reliable protection from overloading, preservation of both a sharp cutting edge and the bit positive rear angle, and maintain other initial parameters throughout the life of the cutting bit.

A plurality of tools have been developed with the objective to achieve some of the above mentioned parameters. The first group of the tools are bits with non-rotatable cutting elements. U.S. Pat. No. 1,174,433 discloses a cutter with a convex front face; however, the angle between its longitudinal axis and the cut surface behind the bit (defined as the attack angle) is less than 90° and the cutter is not protected from overloading or fast dulling of the cutting edge. U.S. Pat. Nos. 4,538,691 and 4,678,237 disclose destructive tools having elements with flat front face, oriented at a substantial negative front angle, that protects from overloading by providing a lifting force, but reduces the bit's cutting ability. The bits are not protected from fast dulling of the cutting edge. The attack angle here does not exceed 90°. U.S. Pat. Nos. 4,538,690; 4,558,753; and 4,593,777 disclose bits with a concave front face, oriented at a large negative front angle, which provides protection from overloading but decreases bit cutting ability. The attack angle also does not exceed 90°. The bit cutting edge is not protected from intensive dulling.

The second group of tools are rotative conical bits with a rock destructive element which can rotate around its own longitudinal axis. In the first sub-group of these tools, the cutting element has a conical shape (direct cone) and destroys the rock by its side surfaces, as disclosed for example in U.S. Pat. Nos. 3,650,565; 3,807,804; and 4,804,231.

These tools are bits of the crushing type that operate without generation of long destructive cracks. The bits are oriented at an attack angle which does not exceed 90° and, as a rule, is no more than 60° and bits are not protected from overloading. They have zero negative rear angle, their rotation around their longitudinal axis is not continuous and reliable. Therefore, their self-sharpening is not reliable, and if it occurs, the cutting element's initial angular parameters are not preserved.

The second group of the rotative bits includes tools which destroy rock with their end concave surfaces, as disclosed, for example, in U.S. Pat. No. 5,078,219. The bit here is a cutting tool, oriented with a small attack angle and is not protected from overloading. Its concave front face does not have a sufficient self-rotating and self-sharpening ability. Its rear angle has zero or negative value, and the bit quickly looses its cutting ability as it wears.

SUMMARY OF THE INVENTION

Accordingly, it is an object of the present invention to provide a method of cutting and a cutting rotative bit, which avoids the disadvantages of the prior art.

More particularly, it is an object of the present invention to provide a method of cutting and a cutting rotative bit which ensures maintenance of the bit's high initial cutting ability for the whole service lifetime, independent of normal bit wear along engagement surfaces.

In keeping with these objects and with others which will become apparent hereinafter, one feature of the present invention resides, briefly stated, in a method of cutting in accordance with which a cutting rotative bit is used with a body and a cutting annular element, connected with the body wherein the cutting element has a front convex face, and in the inventive method the cutting rotative bit is oriented so that an attack angle of the bit and the cutting element exceeds 90°. (Attack angle is the angle between the longitudinal axis of the bit and the cut surface behind the bit).

When the method is performed and the tool is designed in accordance with the present invention, the following advantages are provided:

- Significant cutting ability of the bit, that provides high destruction efficiency of the rock and other similar material;
- Continuous forced self-rotation of the bit around its own longitudinal axis, that provides increase of the bit cutting edge length and uniform wear long its rear face;

Continuous forced self-sharpening of the bit, that provides renewal and maintenance of the initial positive rear angle of the bit along its whole cutting edge;

Self-protection of the bit's cutting element against overloading caused by working material hard spots thereby increasing the bit's reliability;

Increased durability of the bit resulting in high bit reliability and longevity and increased range of working material that may be engaged; due to rational cutting force transmission through the elements of the bit.

Effective operation of the bit until nearly the entire cutting element is consumed by normal wear providing long bit service lifetime.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 5:
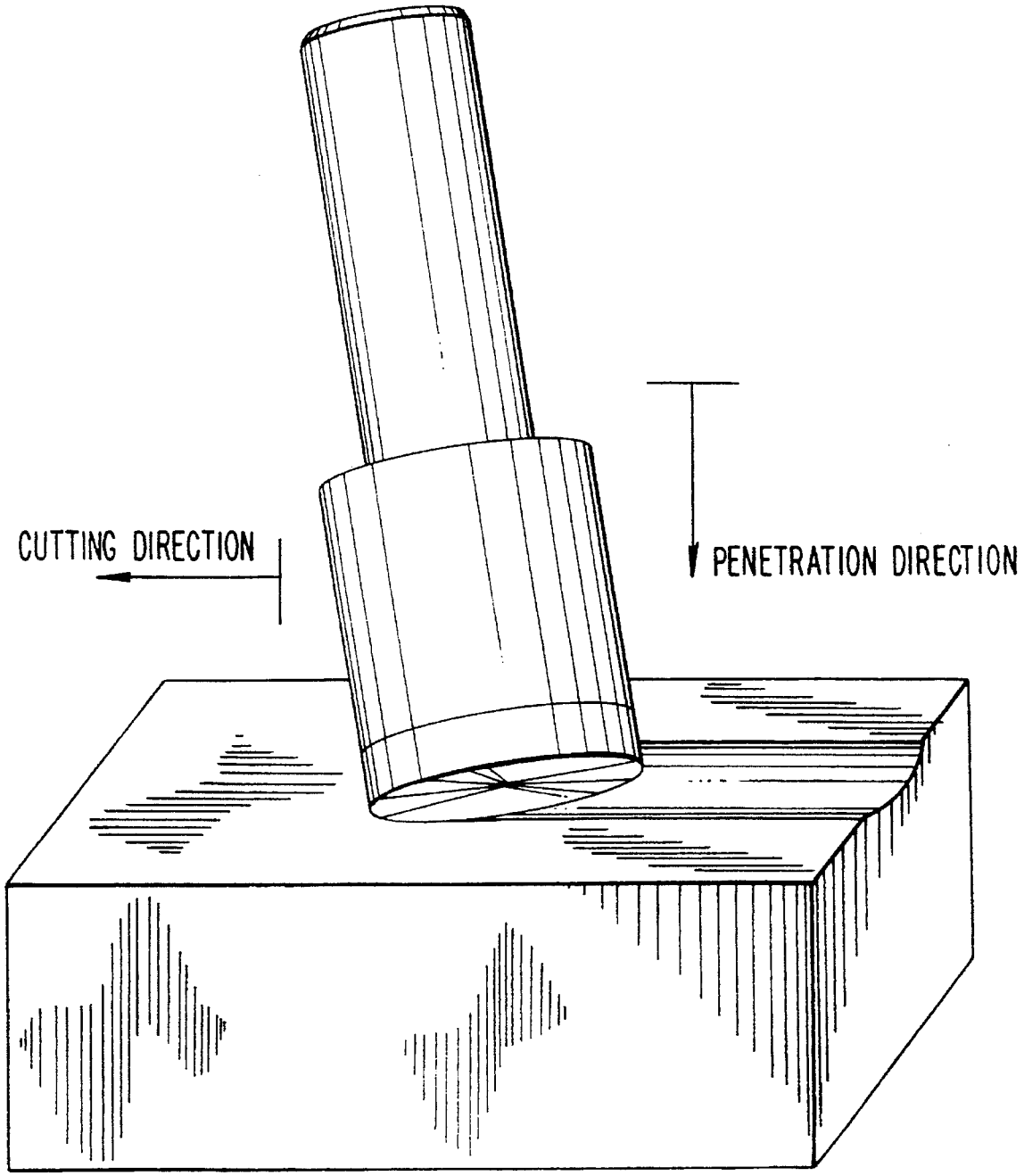
FIG. 5 is a perspective view of a bit in accordance with the present invention during cutting.

A cutting tool (FIGS. 2, 3, and 5) in accordance with present invention has a body which is identified with reference numeral 1 and a cutting element or an insert which is identified with reference numeral 2. The body is further provided with a tail part 3 which contributes to rotation of the bit about its longitudinal axis.

Figure 2:
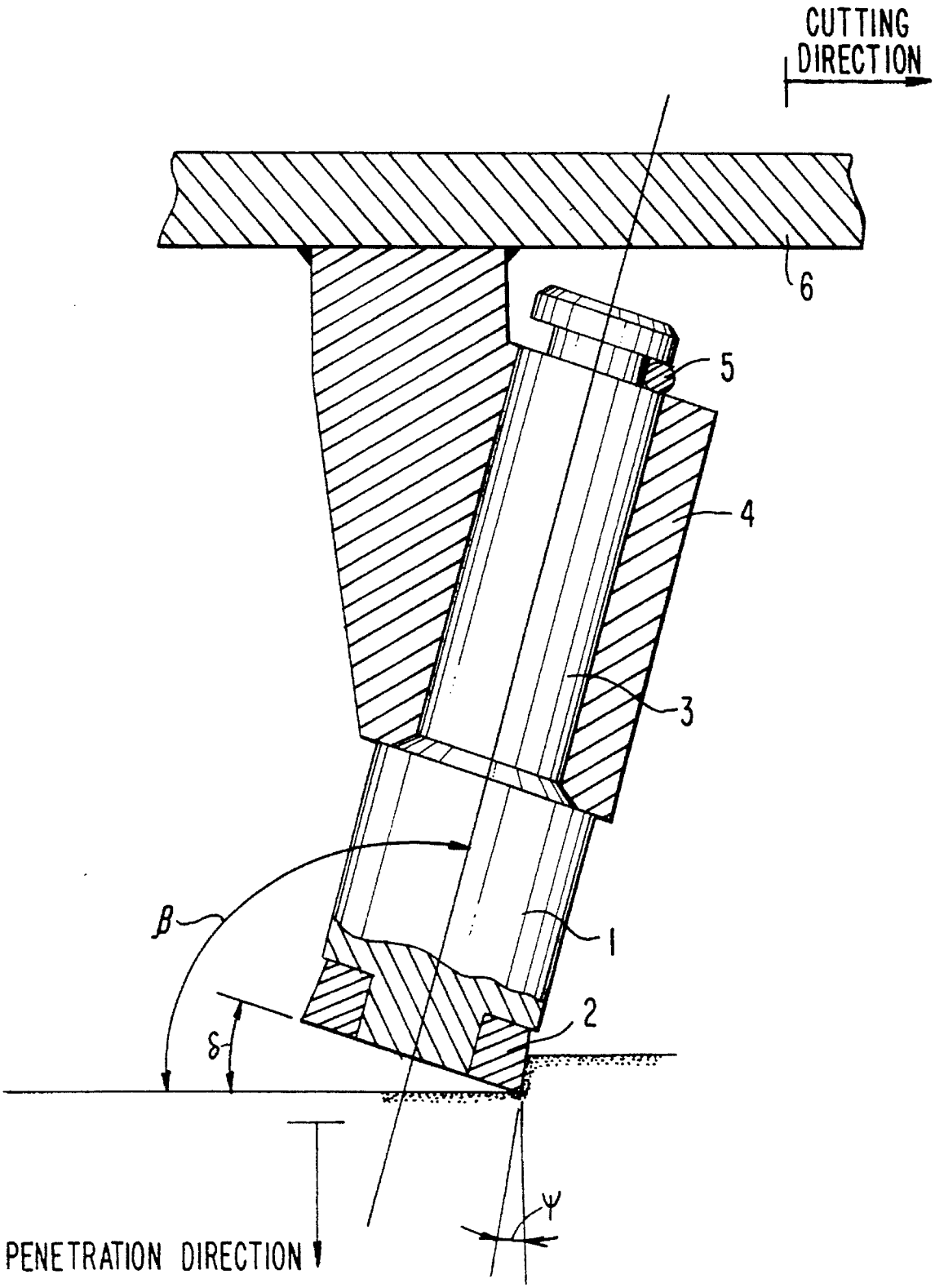
FIG. 2 is a view showing a cutting device provided with that cutting rotative bit in accordance with the present invention.

As can be seen from FIG. 2, the tail part of the bit is arranged in a tool holder 4 and retained by a retainer 5. The tool holder or a plurality of tool holders are aligned with respect to each other and attached to a cutter support 6. The main angles of each cutting rotative bit are determined by mounting of the tool holder to the cutter support as will be discussed hereinbelow. The tail portion of the bit 3 and therefore the cutting rotative bit are held in the tool holder rotatably around its longitudinal axis and fixed in the axial direction.

The cylindrical or conical body is made, as a rule, from alloyed steel, which has a substantial elasticity and a thermal expansion coefficient which is close to that of the insert.

The insert 2 is ring-shaped and can be formed as a solid ring or a composite ring, composed of individual segments. The inner opening of the ring can be cylindrical or conical while its upper surface, which is in contact with the body, may be flat or conical or curved to match the body shape.

Figure 3A:
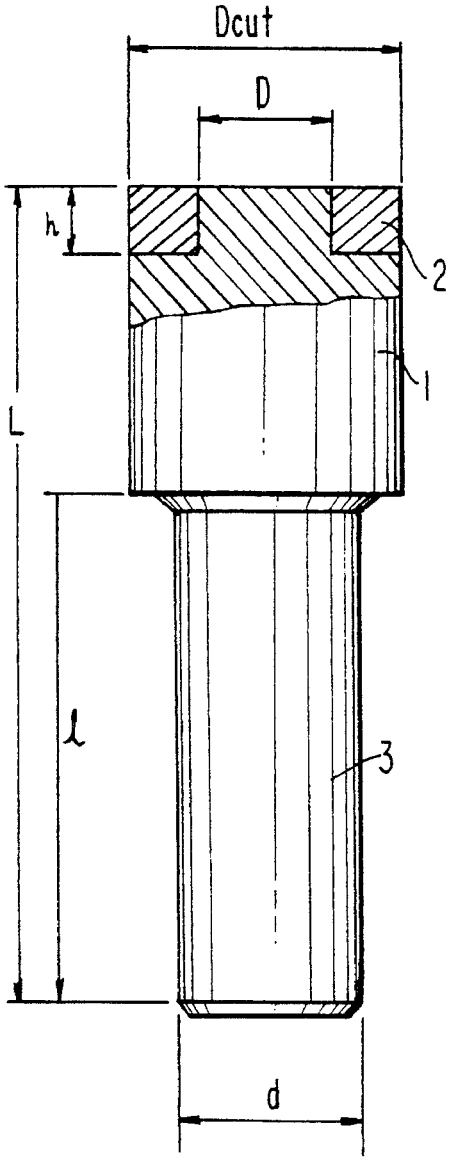
FIG. 3*a* is a view showing the inventive cutting rotative bit with cutting element having the front face of a cylindrical shape and rear face of a flat shape.
Figure 3B:
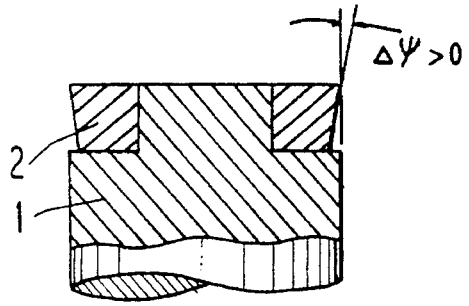
FIG. 3*b* is a view showing the inventive cutting rotative bit cutting element having the front face of an inverse conical shape and rear face of a flat shape.
Figure 3C:
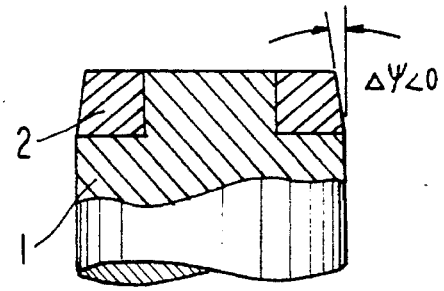
FIG. 3*c* is a view showing the inventive cutting rotative bit cutting element having the front face of a direct conical shape and rear face of a flat shape.
Figure 3D:
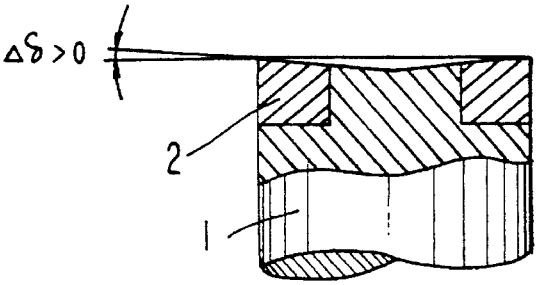
FIG. 3*d* is a view showing the inventive cutting rotative bit cutting element having the front face of a cylindrical shape and rear face of a convex shape.
Figure 3E:
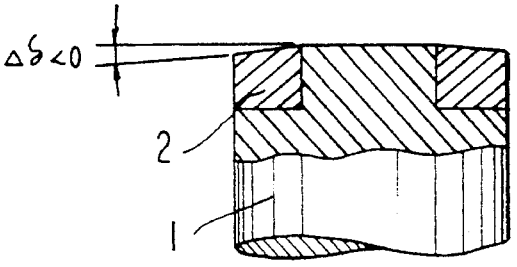
FIG. 3*e* is a view showing the inventive rotative bit cutting element having front face of a cylindrical shape and rear face of a convex shape.

The lower end or surface of the insert can be flat, as shown in FIGS. 3*a*, 3*b*, 3*c*. It can also concave, as shown in FIG. 3*d* or convex, as shown in FIG. 3*e*. The outer surface of the ring which is the front face of the bit always has a convex shape formed by a generatrix of a cylinder, as shown in FIGS. 3*a*, 3*d*, and 3*c*, or direct cone, as shown in FIG. 3*b* or inverse cone, as shown in FIG. 3*c*. The insert, as a rule, is made of hard and brittle wear resistant materials, preferably sintered hard alloys of the tungsten carbide group. The convex shape of the front face of the insert is preferable, since the cutting forces are directed toward the center of the ring and are resolved into mainly safe compressive stresses, instead of tensile stresses which are very dangerous for brittle materials like the hard alloys the insert is composed of.

The convex shape of the front face of the bit also contributes to more efficient removal of the destroyed rock from the cutting zone due to dispersing of cuttings to both sides of the bit.

The connection of the insert to the body can be performed by brazing, in particular for the composite ring, with use of high temperature brazing filler metal, or performed with interference or press fit. The ring-shaped insert provides semi-closed containment of brazing materials to ensure durable and reliable joining of the body and insert which is particularly important in condition of dynamic loads. The press fitting on the other hand, eliminates residual thermal stresses which are characteristic of high temperature brazing due to different expansion coefficients of the joined elements.

The solid bits which are not subdivided into the body and insert are recommended for cutting of non-abrasive materials. It has to be subjected to a special thermal treatment, for example, isothermic quenching to provide different hardness of the body portion and cutting element portion of the bit.

Figures 4A, 4B, 4C:
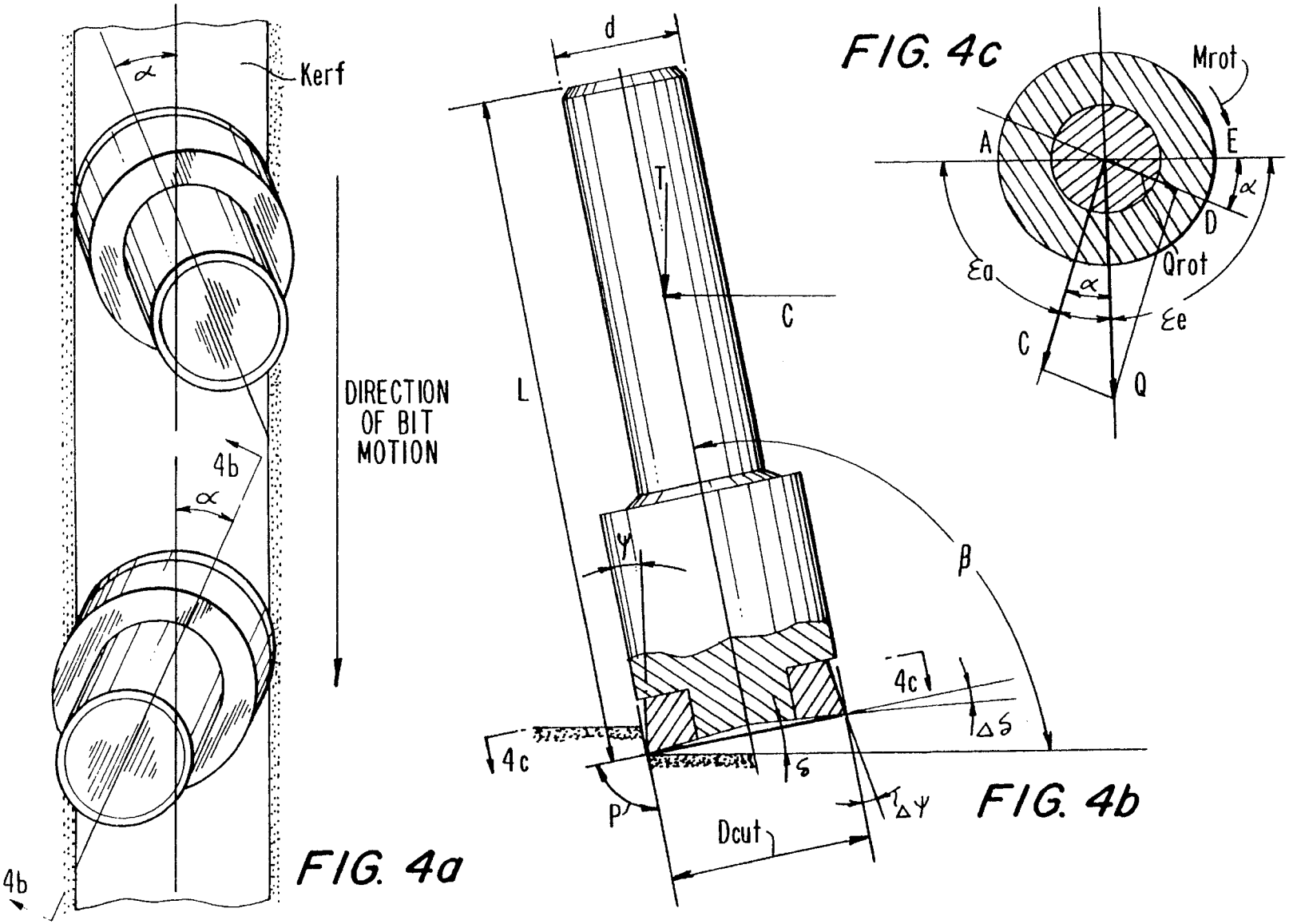
FIG. 4*a* is a plan view of the inventive cutting rotative bit.
FIG. 4*b* is a view showing a longitudinal section of the cutting rotative in accordance with the present invention.
FIG. 4*c* is a transverse cross-section of the inventive cutting rotative bit.

The main new feature of the present invention is that the inventive method is performed so that the cutting rotative bit is oriented to the surface of the rock to be cut at an attack angle $\beta$ which exceeds 90°, as shown in FIGS. 2 and 4*b*.

The attack angle, in accordance with the present invention imparts to the tool a new quality and provides favorable conditions for its efficient operation due to optimization of the main parameters specified hereinabove and producing efficient destruction of the rock.

The skew angle $\alpha$, shown in FIGS. 4*a* and 4*c*, is the angle measured in a horizontal plane between the projection of the longitudinal axis of the tool and the direction of the tool motion. The skew angle determines the force $Q_{rot}$, which produces a rotary moment (torque) on the tool $M_{rot}$ around its longitudinal axis (or in other words causes rotation of the tool on the rock) as well determining the angular parameters of the tool such as a front angle $\psi$, and rear angle $\delta$, as shown in FIG. 4*b* at the point of its self-sharpening, the point E in FIG. 4*c*.

Figure 1:
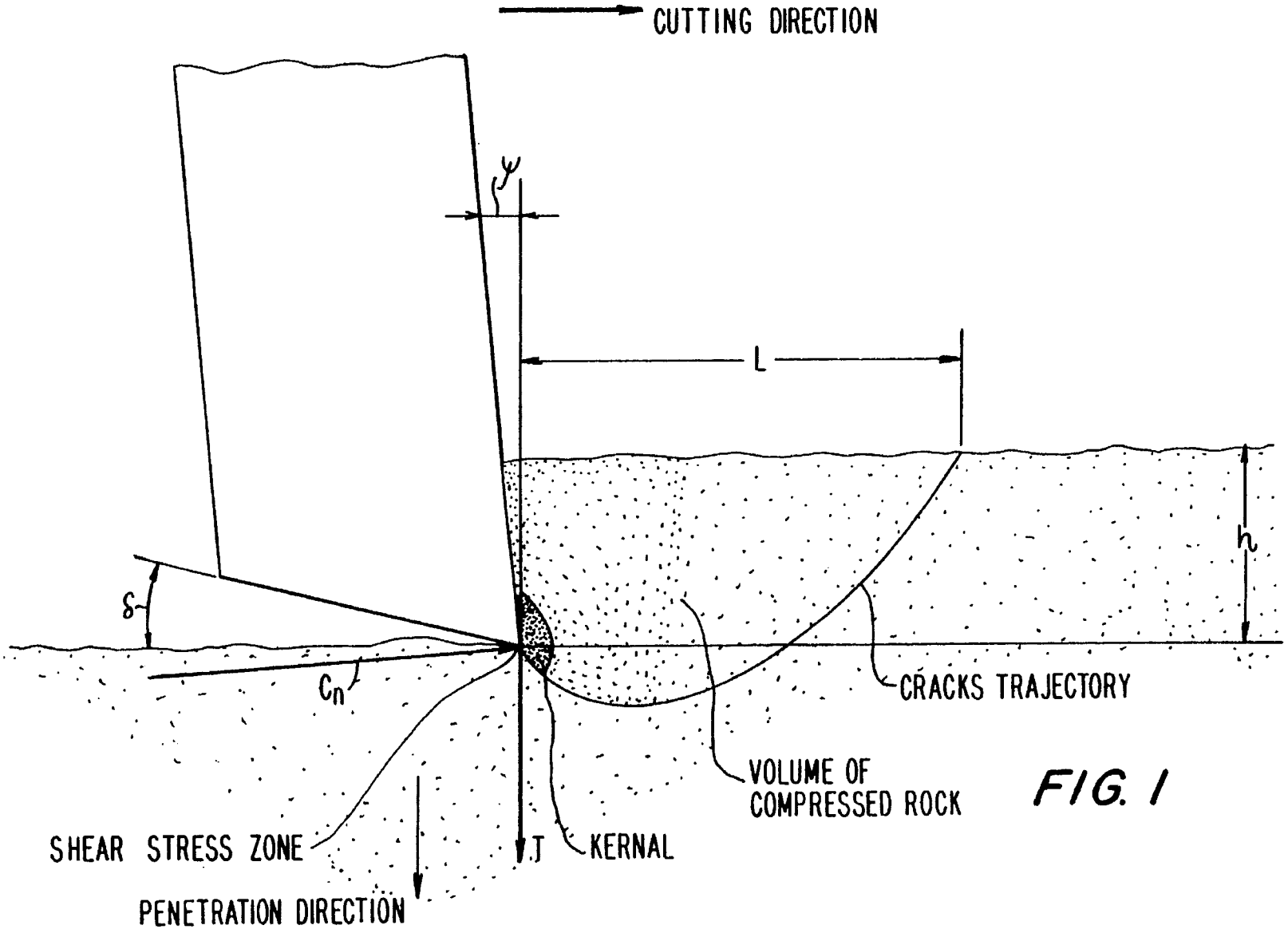
FIG. 1 is a view schematically showing a mechanism of rock destruction.

The front angle $\psi$ of the tool, shown in FIG. 4*b*, determines durability of the tool, the magnitude and direction of the thrust force T and normal component $C_n$ of total cutting force, as shown in FIG. 1. The rear angle $\delta$ shown in FIG. 4*b*, determines the cutting properties of the tool and its durability. The edge angle $\rho$, shown in FIG. 4*b*, determines the durability of the tool.

The spatial orientation of the tool which is determined by the attack angle $\beta$ and the skew angle $\alpha$ imparts the following properties:

The front face of the tool is the convex surface of the insert, while the rear face of the tool is the end surface of the insert;

Each point of the cutting edge of the tool (arc AE in FIG. 4*c*) has the front angle $\psi_i$ and the rear angle $\delta_i$ which are different from those of the remaining points on this cutting edge;

The rotation of the tool around its longitudinal axis (FIGS. 4*b* and 4*c*) is caused due to rolling of the front face of tool along the corresponding surface of the rock under the action of the rotary moment $M_{rot}$ formed by the force $Q_{rot}$;

The direction of the rectilinear moving of the tool does not coincide with the direction of cutting (breaking) of the rock, which is different for each point of the cutting edge of the tool, as shown in FIG. 4*c*.

In the point B in FIG. 4*c*, the rear angle $\delta_b$ has its maximum positive value. Moving away from the point B to the right and to the left, this angle reduces ($\sin \delta_i = \sin \delta_b \cdot \cos \epsilon_i$) and assumes its zero value at point D and a negative value at point E. The geometrical correction of the rear face of the tool by introducing the positive angle $\Delta\delta$ in FIG. 4*b* ($|\Delta\delta| \geqq |\delta_e|$) provides a positive rear angle along the whole cutting edge of the bit (the arc AE in FIG. 4*c*). Therefore, this condition, necessary for high rock stress concentrations at the cutting edge, is maintained.

Under the condition $|\Delta\delta| = |\delta_e|$, the rear angle of the tool at the point E is zero. Therefore, on the radial line at E, self-sharpening occurs to provide continuous renewal and maintaining of the positive rear angle along the whole cutting edge of the tool despite continuous wearing out of the tool along its rear face.

At the point B in FIG. 4*c*, the front angle $\psi_b$ has its maximum negative value. Moving from point B to the right or to the left increases this angle ($\sin \psi_i = \sin \psi_b \cdot \cos \epsilon_i$) so as to assume its zero value at the point D and its positive value at the point E. Therefore, at the point E the specific thrust force will be maximal, when compared with remaining points of the cutting edge of the tool over the arc AE in FIG. 4*c*. This contributes to the continuous efficient self-sharpening of the tool and, in combination with the zero value of the rear angle, creates conditions which are close to machine tool sharpening. The introduction of the positive angle of correction $\Delta\psi$, FIG. 4*b*, the effect of self-sharpening is further increased.

The negative front angle of the tool, which is maximal in central part of the cutting edge of the tool, contributes to the self-protection of the tool against overloading, due to the generation of a lifting force which lifts the tool from the rock. Such overloading is usually caused by the increase of the hardness of the rock to be broken.

The continuous rotation of the tool around its longitudinal axis is reliable due to the following factors:

Absence of substantial resistance to the rotation along the rear face of the tool due to the positive rear angle; and Use of substantial cutting force Q (as compared with the thrust force), which is produced by the drive of the cutting equipment to form the required friction force along the front face of the tool and preventing slippage between the front face of the tool and the rock.

The nature and the axial direction of wear of the tool along the rear face in combination with the continuous renewal by self-sharpening to initial values of the rear angle along the whole cutting edge of the tool provides for efficient operation of the tool in the cutting mode until the wear completely consumes the insert.

The skew angle in accordance with the present invention can be within the range of 0° to 90°, preferably 25°±5°. The front angle can be within the range of plus 30° to minus 15°, preferably minus 7.5°,±2.5°. The rear angle can be within the range from 0° to 30°, preferably 12.5°±2.5°. The edge angle can be within the range of 45°–120°, preferably 75°±15°.

It will be understood that, each of the elements described above, or two or more together, may also find a useful application in other types of methods and constructions differing from the types described above.

While the invention has been illustrated and described as embodied in a method of cutting and a cutting rotative bit, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic aspects of this invention.

What is claimed as new and desired to be protected by Letters Patent is set forth in the appended claims:

1. A cutting, self-rotating and self-sharpening tool, comprising a rotatable cutting element; and means for holding said cutting element so that said cutting element has an attack angle exceeding 90° and a skew angle 25°±5°.

2. A cutting, self-rotating and self-sharpening tool as defined in claim 1, wherein said cutting element has a convex cutting front face.

3. A cutting, self-rotating and self-sharpening tool defined in claim 2, wherein said convex cutting front face has a shape selected from the group consisting of a cylindrical shape, a direct conical shape and an inverse conical shape.

4. A cutting, self-rotating and self-sharpening tool as defined in claim 1, wherein said cutting element has a rear face with a shape selected from the group consisting of a convex shape, a concave shape, a flat shape, and a combination of said shapes.

5. A cutting, self-rotating and self-sharpening tool comprising a rotatable cutting element; and means for holding said cutting element so that said cutting element has an attack angle exceeding 90° and a front angle −7.5°±2.5°.

6. A cutting, self-rotating and self-sharpening tool comprising a rotatable cutting element; and means for holding said cutting element so that said cutting element has an attack angle exceeding 90° and a rear angle 12.5°±2.5°.

7. A cutting, self-rotating and self-sharpening tool comprising a rotatable cutting element; and means for holding said cutting element so that said cutting element has an attack angle exceeding 90° and a edge angle 75°±15°.

8. A method of cutting, comprising the steps of providing a rotatable cutting element; mounting said cutting element by mounting means, and displacing said mounting means so that said cutting element has an attack angle exceeding 90° and a skew angle 25°±5°.

9. A method as defined in claim 8, wherein said cutting element has a convex cutting front face.

10. A method of cutting, comprising the steps of providing a rotatable cutting element; mounting said cutting element by mounting means; and displacing said mounting means so that said cutting element has an attack angle exceeding 90° and a front angle −7.5°±2.5°.

11. A method of cutting, comprising the steps of providing a rotatable cutting element; mounting said cutting element by mounting means; and displacing said mounting means so that said cutting element has an attack angle exceeding 90° and a rear angle 12.5°±2.5°.

12. A method of cutting, comprising the steps of providing a rotatable cutting element; mounting said cutting element by mounting means; and displacing said mounting means so that said cutting element has an attack angle exceeding 90° and a edge angle 75°±15°.

* * * * *